US007030544B2

(12) United States Patent
Yamanaka

(10) Patent No.: US 7,030,544 B2
(45) Date of Patent: Apr. 18, 2006

(54) SPARK PLUG DESIGNED TO ENHANCE STRENGTH OF JOINT OF NOBLE METAL MEMBER TO GROUND ELECTRODE

(75) Inventor: Koji Yamanaka, Kariya (JP)

(73) Assignee: Denso Corporation, (JP)

( * ) Notice: Subject to any disclaimer, the term of this patent is extended or adjusted under 35 U.S.C. 154(b) by 0 days.

(21) Appl. No.: 11/007,179

(22) Filed: Dec. 9, 2004

(65) Prior Publication Data

US 2005/0134160 A1 Jun. 23, 2005

(30) Foreign Application Priority Data

Dec. 19, 2003 (JP) ..... 2003-422061

(51) Int. Cl.
*H01T 13/20* (2006.01)

(52) U.S. Cl. ..... 313/141; 313/144

(58) Field of Classification Search ..... 313/11.5, 313/118, 123, 132, 135, 141, 142, 144
See application file for complete search history.

(56) References Cited

U.S. PATENT DOCUMENTS 4,540,910 A * 9/1985 Kondo et al. ..... 313/141
4,893,051 A * 1/1990 Kondo ..... 313/141
5,866,973 A * 2/1999 Kagawa et al. ..... 313/141
6,045,424 A * 4/2000 Chang et al. ..... 313/141
6,337,533 B1 * 1/2002 Hanashi et al. ..... 313/141
6,472,801 B1 * 10/2002 Matsubara et al. ..... 313/141
6,642,638 B1 * 11/2003 Ishiguro ..... 313/141
2002/0003389 A1 1/2002 Ishiguro

FOREIGN PATENT DOCUMENTS

JP 11-354251 12/1991
JP 2002-93547 3/2002
JP 2002-289319 10/2002

* cited by examiner

*Primary Examiner*—Joseph Williams
*Assistant Examiner*—Peter Macchiarolo
(74) *Attorney, Agent, or Firm*—Nixon & Vanderhye PC

(57) ABSTRACT

An improved structure of a spark plug is provided for improving the mechanical strength of joints between a noble metal member made of Ir-alloy and a ground electrode which withstands intense heat. The noble metal member is welded to the ground electrode through laser-fused portions. Each of the fused portion contains less than 40% by weight of Ir in a range defined inside an imaginary plane coinciding with an outer peripheral wall of the noble metal member before welded to the ground electrode, thereby enhancing the strength of the joints between the noble metal member made and the ground electrode.

6 Claims, 5 Drawing Sheets

SPARK PLUG DESIGNED TO ENHANCE STRENGTH OF JOINT OF NOBLE METAL MEMBER TO GROUND ELECTRODE

CROSS REFERENCE TO RELATED DOCUMENT

The present application claims the benefit of Japanese Patent Application No. 2003-422061 filed on Dec. 19, 2003, the disclosure of which is incorporated herein by reference.

BACKGROUND OF THE INVENTION

1. Technical Field of the Invention

The present invention relates generally to a spark plug which may be employed in automotive vehicles, gas feed pumps and cogeneration systems, and more particularly to a spark plug designed to enhance the mechanical strength of a joint of a noble metal member made of, for example, an Ir (Iridium) alloy to a ground electrode.

2. Background Art

Japanese Patent First Publication Nos. 11-354251 and 2002-93547 propose a spark plug of the above type which consists essentially of a metal shell, a center electrode retained in the metal shell in electrical insulation therefrom, and a Ni-based alloy made ground electrode. The ground electrode has joined thereon a noble metal chip which is made of Ir alloy and faces the center electrode through the spark gap.

The noble metal chip is laser-welded to the ground electrode, thereby forming wedge-shaped fused portions (also called weld nuggets) in which materials of the noble metal chip and the ground electrode are melted together to produce mechanical joints of the noble metal chip to the ground electrode.

Use of the laser welding to form the fused portions between the ground electrode and the noble metal chip results in a decrease in thermal stress airings from a difference in coefficient of linear expansion between the noble metal chip and the ground electrode.

Japanese Patent First Publication No. 11-354251 teaches a joining method of placing the noble metal chip on an area of the ground electrode facing the center electrode and emitting laser beams to the surface of the noble metal chip to form the wedge-shaped fused portions which taper from the outer surface of the noble metal chip to inside the ground electrode.

Japanese Patent First Publication No. 2002-93547 teaches another joining method of forming a recess in an area of the ground electrode facing the center electrode, fitting the noble metal chip in the recess, and emitting laser beams to the outer surface of the ground electrode to form the wedge-shaped fused portions which taper from the outer surface of the ground electrode to inside the recess. This structure is effective in improving the reliability of a joint of the noble metal chip to the ground electrode.

In recent years, higher engine output and lower fuel consumption and exhaust emissions requirements have been increased, thus resulting in elevated temperatures of a combustion atmosphere in the engines.

The inventor of this application has researched the strength of the joint between the noble metal chip and the ground electrode of the spark plug of the type, as taught in Japanese Patent First Publication No. 2002-93547, and found that when the ground electrode which will usually be the highest in temperature of the spark plug during combustion in the engine is exposed to intense heat, it may result in cracks in the fused portions which, in the worst case, causes the noble metal chip to drop out of the ground electrode, thus leasing to the misfires.

SUMMARY OF THE INVENTION

It is therefore a principal object of the invention to avoid the disadvantages of the prior art.

It is another object of the invention to provide an improved structure of a spark plug designed to improve the strength of a joint between an Ir-alloy tip and a ground electrode enough to withstand exposure to intense heat.

The inventor of this application performed tests on a spark plug which has an Ni-alloy-made ground electrode and a noble metal member made of an Ir-alloy welded to the ground electrode through wedge-shaped fused portions (i.e., weld nuggets) and found that when the percentage of Ir content in a volume of each of the fused portions interfacing with an outer peripheral surface of the noble metal member before welded to the ground electrode lines within a specified range, it results in an improved mechanical strength of a joint between the noble metal member and the ground electrode (see FIG. 6). The invention was made in view of such researches.

According to one aspect of the invention, there is provided a spark plug which may be employed in automotive vehicles, gas feed pumps and cogeneration systems. The spark plug comprises: (a) a metal shell; (b) a center electrode retained within the metal shell to be insulated electrically from the metal shell; (c) a ground electrode which is made of a Ni-based alloy and retained by the metal shell, the ground electrode having a center electrode-facing surface opposed to the center electrode; (d) an Ir-alloy member which is welded to the center electrode-facing surface of the ground electrode and opposed to the center electrode through a spark gap; and (e) fused portions which are formed by welding of the Ir-alloy member to the ground electrode to establish joints between the ground electrode and the Ir-alloy member and include a melted mixture of materials of the ground electrode and the Ir-alloy member. Each of the fused portions contains less than 40% by weight of Ir in a range defined inside an imaginary plane coinciding with an outer peripheral wall of the Ir-alloy member before welded to the ground electrode. This results in improved mechanical strength of the joints between the ground electrode and the Ir-alloy member which withstands intense heat during combustion.

In the preferred mode of the invention, each of the fused portions may contain less than 18% by weight of Ir in the range defined inside the imaginary plane coinciding with the outer peripheral wall of the Ir-alloy member before welded to the ground electrode. This results in further improved mechanical strength of the joints between the ground electrode and the Ir-alloy member.

The center electrode-facing surface of the ground electrode may have formed therein a recess in which the Ir-alloy member is embedded. Each of the fused portions tapers from an outer wall of the ground electrode to inside a portion of the Ir-alloy member located within the recess. This structure serves to enhance the stability of the joints between the ground electrode and the Ir-alloy member.

The Ir-alloy member may be made of a material containing 50% or more by weight of Ir and an additive of at least one of Rh, Pt, Ni, W, Pd, Ru, Os, Al, Y, and $Y_2O_3$.

The content of Ir in the Ir-alloy member may be within a range of 70% by weight to 99% by weight.

The ground electrode may be made of a material containing 95% or more by weight of Ni. This enhances the heat dissipation from the ground electrode as compared with when the ground electrode is made from an Inconel (trade mark) alloy, thus minimizing cracks in the fused portions arising from the thermal stress.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 2(*b*) is a sectional view taken along the line A—A in FIG. 2(*a*);

FIG. 4(*b*) is a partially vertical sectional view of FIG. 4(*a*);

FIG. 4(*c*) is a partially horizontal sectional view which shows another comparative example in which tips of laser-fused portions do not reach an Ir-alloy member;

FIG. 4(*d*) is a partially vertical sectional view of FIG. 4(*c*);

FIG. 7(*b*) is a partially vertical sectional view of FIG. 7(*a*);

FIG. 8(*b*) is a partially vertical sectional view of FIG. 8(*a*).

DESCRIPTION OF THE PREFERRED EMBODIMENTS

Figure 1:
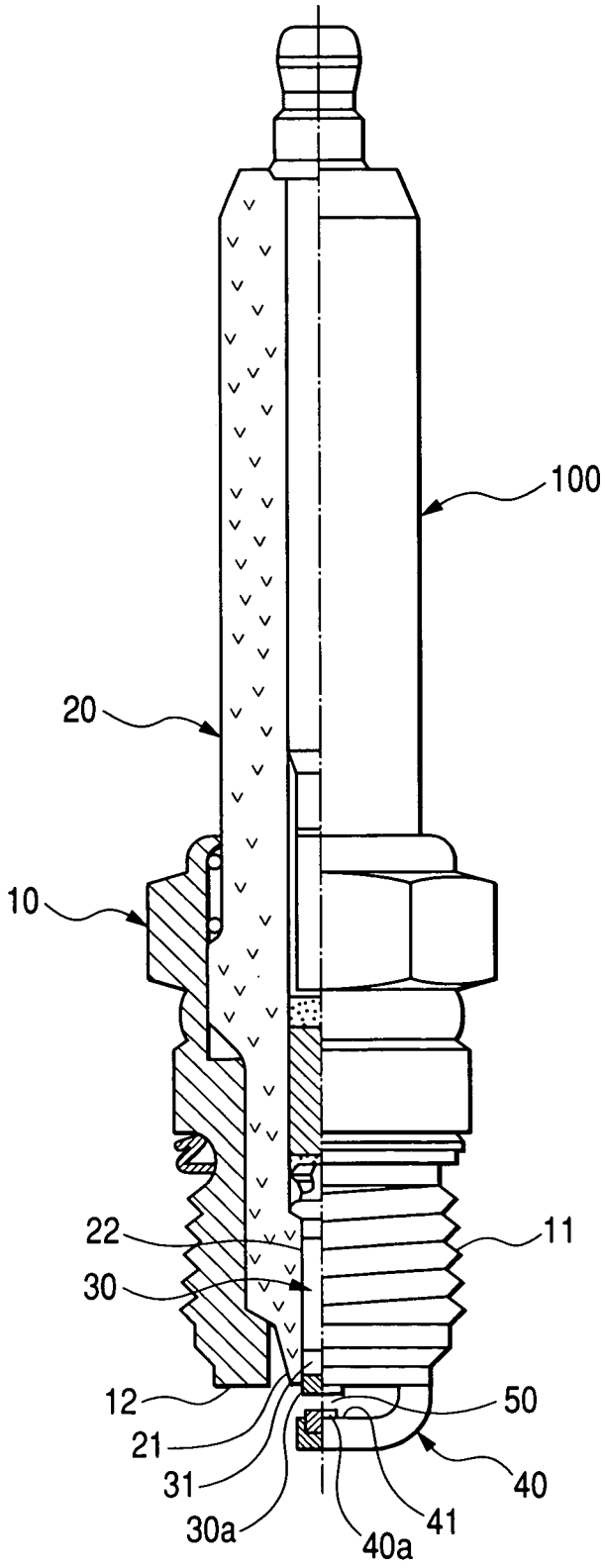
FIG. 1 is a partially sectional view which shows a spark plug with an Ir-alloy member on a ground electrode according to the invention.

Referring to the drawings, wherein like reference numbers refer to like parts in several views, particularly to FIG. 1, there is shown a spark plug 100 which may be used in a gas engine of a generator in a cogeneration system.

The spark plug 100 includes a hollow cylindrical metal shell 10, a porcelain insulator 20, a center electrode 30, and a ground electrode 40. The metal shell 10 has cut therein a thread 11 for mounting the spark plug 100 in an engine block (not shown). The porcelain insulator 20 made of an alumina ceramic ($Al_2O_3$) is retained within the metal shell 10 and has a tip 21 exposed outside an end 12 of the metal shell 10.

The center electrode 30 is secured in an axial chamber 22 of the porcelain insulator 20 and insulated electrically from the metal shell 10. The center electrode 30 has a tip 31 projecting from the tip 21 of the porcelain insulator 20 outside the end 12 of the metal shell 10.

The center electrode 30 is made of a cylinder which consists of a core portion made of a metallic material such as Cu having a higher thermal conductivity and an external portion made of a metallic material such as an Ni-based alloy having higher thermal and corrosion resistances. The center electrode 30 also has a noble metal member 30*a* which is made of an Ir-based alloy and welded to the tip 31.

The ground electrode 40 is made of a bar and welded at an end to the end 12 of the metal shell 10. The ground electrode 40 is bent to an L-shape to have the other end thereof face the tip 31 of the center electrode 30 through a spark gap 50. In the following discussion, an inside side surface of the ground electrode 40 facing the center electrode 30 will be referred to as a center electrode-facing surface 41 below.

The center electrode-facing surface 41 has joined thereto a noble metal member 40*a* which is made of an Ir-based alloy and works to produce a sequence of sparks between itself and the noble metal member 30*a* of the center electrode 30.

Figure 2A:
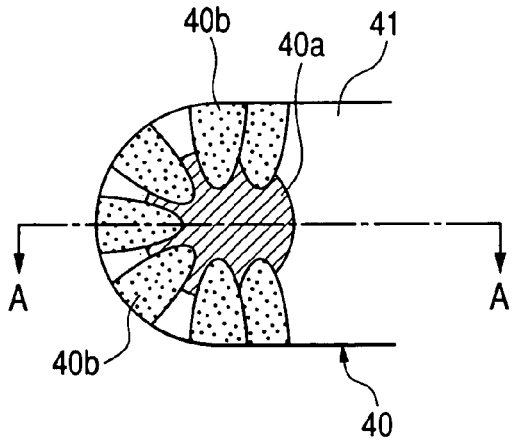
FIG. 2(*a*) is a partially enlarged sectional view, as taken along the line B—B in FIG. 2(*b*), which shows joints between an Ir-alloy member and a ground electrode.
Figure 2B:
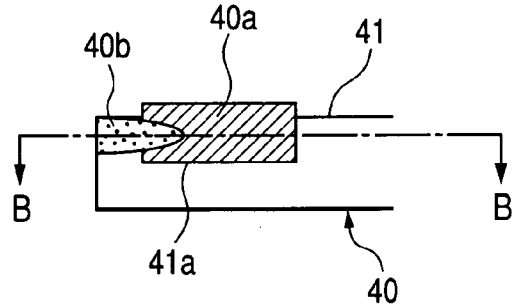

The noble metal member 40*a* is, as can be seen from FIGS. 2(*a*) and 2(*b*), laser-welded to the ground electrode 40 to form wedge-shaped fused portions 40*b* (also called weld nuggets). more specifically generally cone-shaped or dome-shaped fused portions having a rounded apex. in which materials of the ground electrode 40 and the noble metal member 40*a* are melted together, thereby producing mechanical joints between the ground electrode 40 and the noble metal member 40*a*. Specifically, the fused portions 40*b* are each made of alloy including the materials of the ground electrode 40 and the noble metal member 40*a*.

The ground electrode 40 has formed in the center electrode-facing surface 41 a recess 41*a* in which the noble metal member 40*a* is fitted.

Each of the fused portions 40*b* is of a wedge-shape tapering from the outer surface of the ground electrode 40 into the noble metal member 40*a* and having a rounded tip.

The noble metal member 40*a* may be made from material containing 50% or more by weight of Ir and an additive of at least one of Rh, Pt, Ni, W, Pd, Ru, Os, Al, Y, and $Y_2O_3$. The noble metal member 40 preferably contains from 70% to 99% by weight of Ir.

The noble metal member 40*a* is, although not limited to, of a cylindrical shape. The noble metal member 40*a* has an axis extending in alignment with that of the noble metal member 30*a* of the center electrode 30.

The ground electrode 40 is preferably made of material containing 95% or more by weight of Ni.

The ground electrode 40 of this embodiment is designed to have the fused portions 40*b* containing less than 40 Wt %, preferably, less than 18 Wt % of Ir in a range defined near an imaginary cylindrical plane coinciding with an outer peripheral side wall of the noble metal member 40*a* before welded to the ground electrode 40. This range will also be referred to a specific Ir-containing range below.

Figure 3:
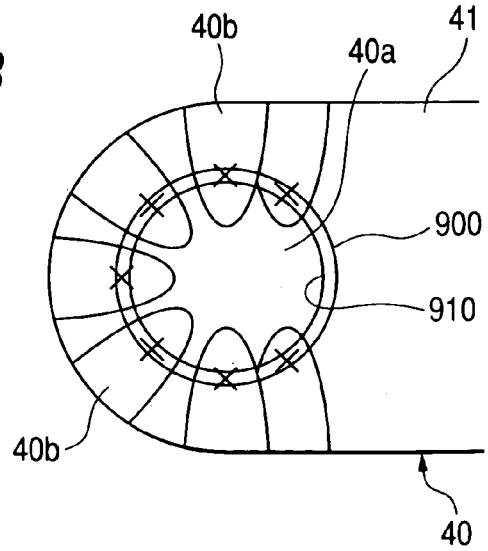
FIG. 3 is a sectional view which shows a specific Ir-containing range of laser-fused portions which form joints between a noble metal member and a ground electrode.
Figure 4A:
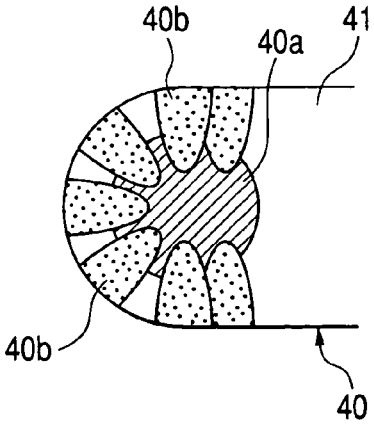
FIG. 4(*a*) is a partially horizontal sectional view which shows a comparative example in which tips of laser-fused portions extend partially outside an Ir-alloy member.
Figure 4C:
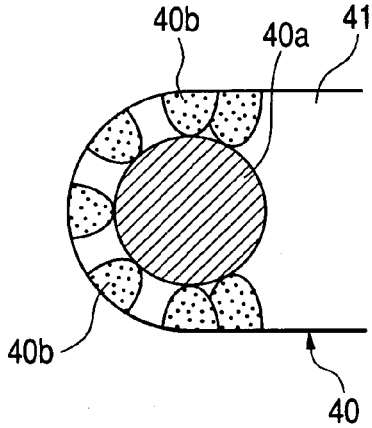
Figure 4B:
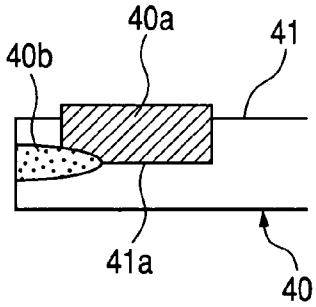
Figure 4D:
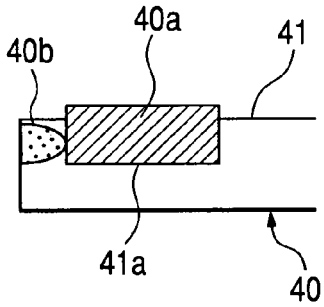

FIG. 3 is a cross sectional view, taken along the line B—B in FIG. 2(*b*). A circled solid line 900 represents an interface between the outer peripheral side wall of the noble metal member 40*a* and an inner peripheral side wall of the recess 41*a* of the ground electrode 40 before they are welded together, that is, before the fused portions 40*b* are formed. The solid line 900 will also be referred to as a first circle below. The diameter of the first circle 900 is identical with that of the noble metal member 40*a* of the ground electrode 40 itself. The specific Ir-containing range occupies volumes of the fused portions 40*b* inside the first circle 900.

For example, if a second circle 910, as illustrated in FIG. 3, which has a diameter smaller by 5% of the first circle 900 is defined inside the first circle 900, the specific Ir-containing range lies between the first and second circles 900 and 910.

The noble metal member 40*a* of the ground electrode 40 may alternatively be made of a polygonal rod (e.g., a square rod). In this case, the specific Ir-containing range may be defined between the interface between the outer peripheral side wall of the noble metal member 40*a* and the inner peripheral side wall of the recess 41*a* of the ground electrode 40 and a line defined inside the interface by 5% of the distance between diametrically opposed sides of a cross section of the rod.

The joining between the ground electrode 40 and the noble metal member 40*a* is accomplished in the following manner.

First, the noble metal member 40*a* is placed on the center electrode-facing surface 41 of the ground electrode 40 and then forced into the recess 41*a* to form a press fit in the recess 41*a*.

Next, laser beams are radiated in a direction from the outer side wall of the ground electrode 40 to inside the recess 41*a* to form the fused portions 40*b* including a mixture of the materials of the ground electrode 40 and the noble metal member 40*a*.

The recess 41*a* may be formed in the ground electrode 40 by cold forging or cutting. The joining of the noble metal member 40*a* to the ground electrode 40 may be achieved by placing the noble metal member 40*a* within the recess 41*a* and leaser-welding them in the same manner as described above.

The noble metal member 40*a* projects partially from the center electrode-facing surface 41 of the ground electrode 40 toward the center electrode 30 to form the spark gap 50, as illustrated in FIG. 1, between itself and the noble metal member 30*a* of the center electrode 30.

FIGS. 4(*a*) and 4(*b*) illustrate an example where each of the fused portions 40*b* is formed partially outside the bottom of the noble metal member 40*a* of the ground electrode 40. FIGS. 4(*c*) and 4(*d*) illustrate another example where each of the fused portions 40*b* does not reach the noble metal member 40*a*, in other words, each of the fused portions 40*b* does not contain a melted mixture of the materials of the ground electrode 40 and the noble metal member 40*a*. Either case is insufficient in melting of the ground electrode 40 into the noble metal member 40*a*, which may cause the noble metal member 40*a* to be removed undesirably.

The reason that, in the specific Ir-containing range, each of the fused portions 40*a* contains less than 40 Wt %, preferably, less than 18 Wt % of Ir will be described below in detail.

The inventor of this application researched, as an example, relations between the percentage of Ir content in the specific Ir-containing range and the mechanical strength of a joint between the ground electrode 40 and the noble metal member 40*a* of the spark plug 100, as illustrated in FIGS. 1, 2(*a*), and 2(*b*).

The inventor prepared samples of the spark plug 100 in which the noble metal member 40*a* is implemented by a cylindrical bar which is made from an Ir-based alloy containing 90% by weight of Ir and 10% by weight of Rh, 2.4 mm in diameter, and 0.9 mm in length.

The inventor measured the percentage of Ir content in a portion of each of the fused portions 40*b*, as represented by "X" between the first and second circles 900 and 910 in FIG. 3. The measurement was made using an EPMA (Electron Probe Microanalyzer).

The strength of the joint between the ground electrode 40 and the noble metal member 40*a* of each spark plug sample was evaluated before and after a durability test. The durability tests were performed by installing the spark plug samples different in the percentage of Ir content in a 6-cylinder gas cogeneration engine and running the engine for 500 hours under a condition of a rated engine output.

Figure 5:
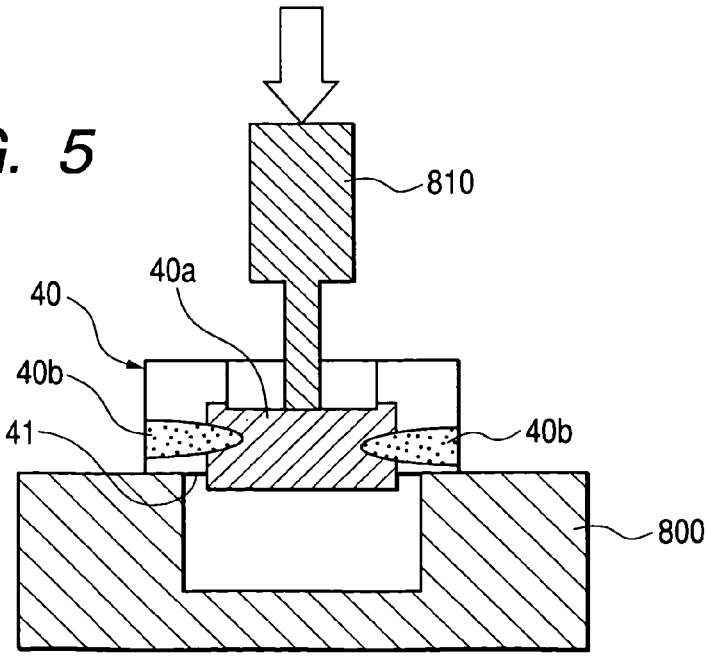
FIG. 5 is a vertical sectional view which shows how to measure the strength of a joint between a ground electrode and an Ir-alloy member of each spark plug test sample.

FIG. 5 illustrates how to measure the strength of the joint between the ground electrode 40 and the noble metal member 40*a* of each spark plug sample. First, the surface of the ground electrode 40 opposite the center electrode-facing surface 41 was bored to expose the noble metal member 40*a*. Next, the ground electrode 40 was placed on the base 800 with the center electrode-facing surface 41 facing the base 800. The noble metal member 40*a* was pressed downward, as viewed in FIG. 5, using a pin 810. The strength of the joint between the noble metal member 40*a* and the ground electrode 40 was measured using a tension tester.

It is still found from past other researches that the value, as measured by the tension tester, represents the mechanical strength of the joint between the ground electrode 40 and the noble metal member 40*a*, and that when the joint strength is less than or equal to 10N (Newton), it results in an increased possibility of removal of the noble metal member 40*a* from the ground electrode 40. Specifically, it is found that when the joint strength is more than 10N, it ensures the joint strength of the noble metal member 40*a* sufficient from a practical standpoint.

Figure 6:
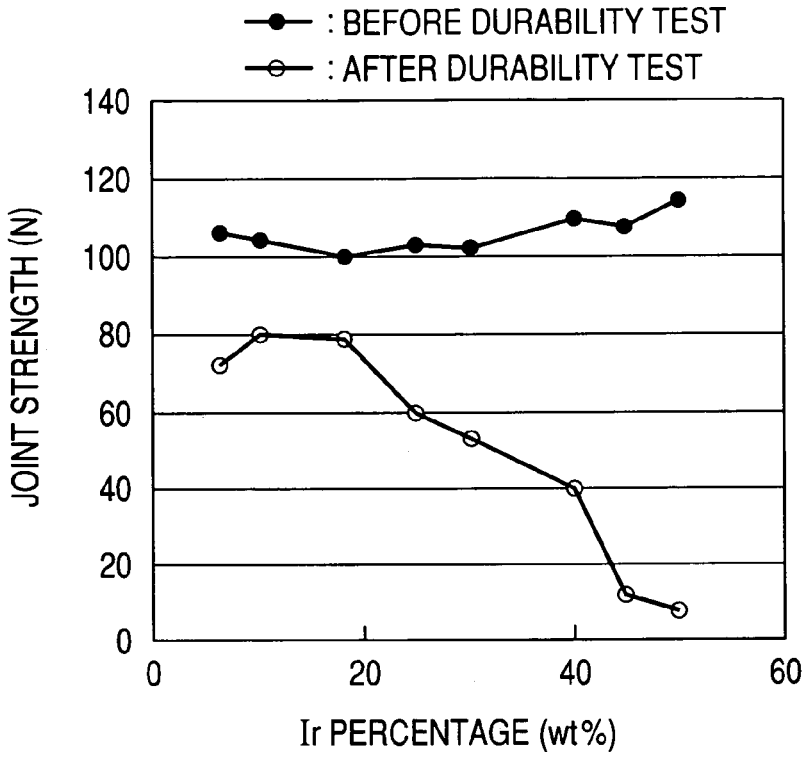
FIG. 6 is a graph which shows relations between the percentage of Ir content in laser-fused portions and the joint strength of an Ir-alloy member of each spark plug test sample before and after the durability test.

FIG. 6 is a graph which shows relations between the percentage of Ir content in the fused portions 40*b* and the joint strength of the noble metal member 40*a* of each spark plug sample before and after the durability test, as described above. Black plots indicates the joint strengths before the durability tests. White plots indicate the joint strengths after the durability tests.

The graph shows that the joint strength does not change greatly with a change in Ir content in the fused portions 40*b* before the durability tests, while, after the durability tests, it drops greatly when the Ir content exceeds 40 Wt %.

Figure 7A:
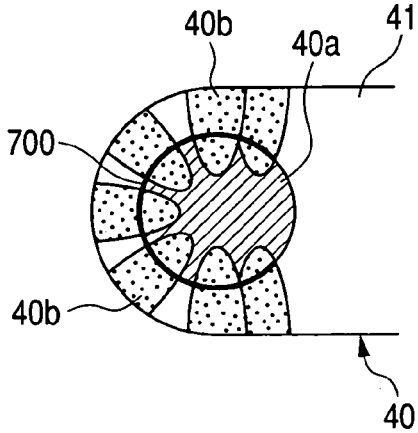
FIG. 7(*a*) is a partially horizontal sectional view which shows cracks occurring in laser-fused portions.
Figure 7B:
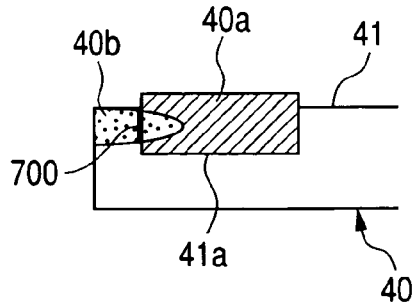

The inventor further conducted searches on the spark plug samples in detail and found that when the percentage of Ir content is 40 Wt % or more, it results in great oxidization of the fused portions 40*b*, causing cracks to occur, as indicated by solid lines 700 in FIGS. 7(*a*) and 7(*b*), in the fused portions 40*b* at interfaces between the inner peripheral side wall of the recess 41*a* of the ground electrode 40 and the outer peripheral side wall of the noble metal member 40*a* before being laser-welded together, which leads to a drop in the joint strength.

The graph of FIG. 6 shows that when the percentage of Ir content is less than 40 Wt %, it results in the greatly improved joint strength of the fused portions 40*b*.

Figure 8A:
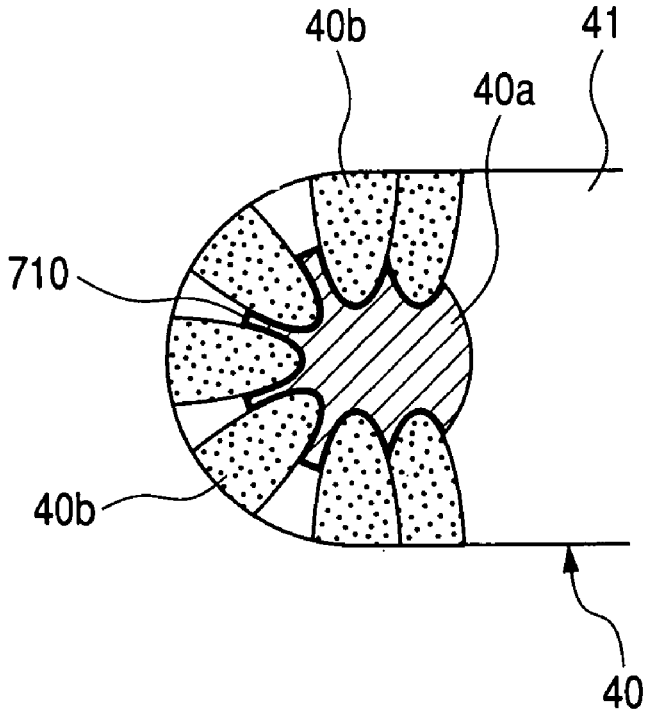
FIG. 8(*a*) is a partially horizontal sectional view which shows cracks in interfaces between laser-fused portions and an Ir-alloy member.
Figure 8B:
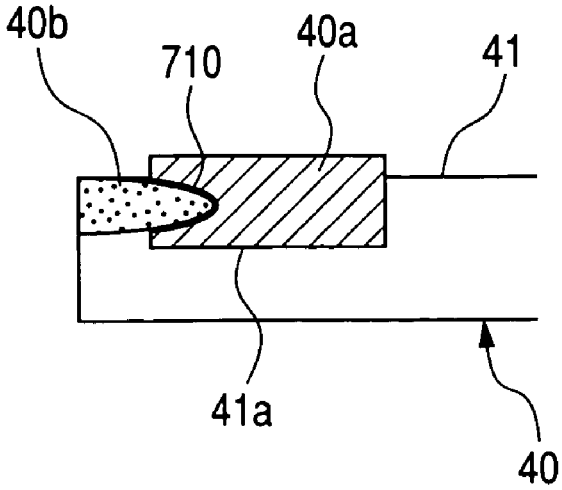

The inventor also found that even when the percentage of Ir content is less than 40 Wt %, it may result in cracks, as indicated by solid lines 710 in FIGS. 8(*a*) and 8(*b*), at interfaces between the fused portions 40*b* and the noble metal member 40*a*, but however, the fused portions 40*b* serves to ensure a desired degree of strength of the joint between the ground electrode 40 and the noble metal member 40*a*.

The graph of FIG. 6 also shows that when the percentage of Ir content in the fused portions 40*b* is less than 18 Wt %, the joint strength is saturated to a maximum level. This may be because when an Ir content of less than 18 Wt % serves to undermine the growth of the cracks.

From the above researches, the inventor has found that the percentage of the Ir content of the fused portions 40*b* is less than 40 Wt %, preferably, less than 18 Wt % in the specific Ir-containing range, as described above, in terms of the strength of the joint between the ground electrode 40 and the noble metal member 40*a*.

As apparent from the above discussion, the spark plug 100 of this embodiment is designed to have the noble metal member 40*a* joined to the recess 41*a* formed in the ground electrode 40 through the fused portions 40*b* which taper from the outer periphery of the ground electrode 40 to inside the noble metal member 40*a* and contain less than 40 Wt % of Ir in the specified range, as described above, thereby improving the reliability of joining between the ground electrode 40 and the noble metal member 40*a*.

It is, as already described, preferable that the ground electrode 40 contains 95% or more by weight of Ni. This enhances the heat dissipation from the ground electrode 40 as compared with when the ground electrode 40 is made from an Inconel (trade mark) alloy, thus minimizing cracks in the fused portions 40*b* arising from the thermal stress. Specifically, use of such a material results in a quick reduction in temperature of the fused portions 40*b* during combustion of the engine, thus decreasing the thermal stress caused by a difference in linear expansion between the fused portions 40*b* and the ground electrode 40, which minimizes cracks in the ground electrode 40. The quick reduction in temperature of the fused portions 40*b* also results in decreases in oxidization-caused volatilization of Ir and the above described oxidization-caused cracks.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A spark plug comprising:

a metal shell;

a center electrode retained within said metal shell to be insulated electrically from said metal shell;

a ground electrode which is made of a Ni-based alloy and retained by said metal shell, said ground electrode having a center electrode-facing surface opposed to said center electrode;

an Ir-alloy member which is welded to the center electrode-facing surface of said ground electrode and opposed to said center electrode through a spark gap; and fused portions which are formed by welding of said Ir-alloy member to said ground electrode to establish joints between said ground electrode and said Ir-alloy member and include a melted mixture of materials of said ground electrode and said Ir-alloy member, each of the fused portions containing less than 18% by weight of Ir in a range defined inside an imaginary plane coinciding with an outer peripheral wall of said Ir-alloy member before welded to said ground electrode, wherein the center electrode-facing surface of said ground electrode has formed therein a recess in which said Ir-alloy member is embedded, and wherein each of said fused portions extends from an outer side surface of said ground electrode, between the center electrode-facing surface and a surface opposed to the center electrode-facing surface, to inside a portion of said Ir-alloy member located within the recess.

2. A spark plug as set forth in claim 1, wherein said Ir-alloy member is made of a material containing 50% or more by weight of Ir and an additive of at least one of Rh, Pt, Ni, W, Pd, Ru, Os, Al, Y, and $Y_2O_3$.

3. A spark plug as set forth in claim 1, wherein a content of Ir in said Ir-alloy member is within a range of 70% by weight to 99% by weight.

4. A spark plug as set forth in claim 1, wherein said ground electrode is made of a material containing 95% or more by weight of Ni.

5. A spark plug as set forth in claim 1, wherein the recess has a bottom facing said center electrode and a side wall continuing from the bottom, the side wall forming an interface between itself and said Ir-alloy member, and wherein each of the fused portions extends into said Ir-alloy member through the interface to establish said joints between said ground electrode and said Ir-alloy member.

6. A spark plug as set forth in claim 1, wherein said range is 5% of a distance between diametrically opposite sides of said Ir-alloy member near said plane.

* * * * *